United States Patent [19]

Khan

[11] 4,268,013

[45] May 19, 1981

[54] CRANE MOTION COMPENSATOR

[75] Inventor: Farooq A. Khan, Houston, Tex.

[73] Assignee: NL Industries, Inc., New York, N.Y.

[21] Appl. No.: 914,834

[22] Filed: Jun. 12, 1978

[51] Int. Cl.[3] ..... B66D 1/48

[52] U.S. Cl. ..... 254/392; 91/207; 91/417 R; 92/108; 175/27

[58] Field of Search ..... 254/172, 173 R; 212/3 R, 3 A, 35 R, 35 HC, 57, 58 R; 175/5, 27; 114/213-215, 230; 91/417 R, 207, 390; 92/108; 414/137-139

[56] References Cited

U.S. PATENT DOCUMENTS

| | | | |
|---|---|---|---|
| 3,309,065 | 3/1967 | Prud'homme et al. | 254/172 |
| 3,653,635 | 4/1972 | Bates et al. | 254/172 |
| 3,687,205 | 8/1972 | Mori | 175/5 X |
| 3,707,922 | 1/1973 | Dillon | 254/172 X |
| 3,804,183 | 4/1974 | Duncan et al. | 254/172 X |
| 3,865,066 | 2/1975 | White et al. | 254/172 X |
| 3,871,527 | 3/1975 | Schimmeyer et al. | 254/172 X |
| 3,905,580 | 9/1975 | Hooper | 254/172 |
| 3,912,227 | 10/1975 | Meeker et al. | 254/172 |
| 4,025,055 | 5/1977 | Strolenberg | 254/172 |

*Primary Examiner*—John M. Jillions

*Attorney, Agent, or Firm*—Arnold, White & Durkee

[57] ABSTRACT

A method and apparatus are disclosed for displacing a crane lift hook and hook cable to follow the relative vertical motion between a crane and a loading deck such as occurs between floating vessels and a fixed crane. In the method, the hook cable is paid out or reeled in to maintain the hook a substantially constant distance from the deck in order to facilitate loading or unloading of cargo from the hook. The apparatus for achieving the method includes a vertically displaceable sheave over which the lift cable is reeved, a power ram to displace the sheave, and motive means operating the power ram. Preferably, the power ram is subjected to a constant upward pneumatic force to provide at least a portion of the force for displacing the moveable sheave upwardly to reel in the cable, such as in response to an upward heave of the deck relative to the crane. Variable displacement hydraulic pumps provide an additional hydraulic upward force to the power ram or alternatively provide a downward hydraulic force to displace the ram downwardly against the constant pneumatic force in order to displace the sheave down and pay out the cable, such as when the deck moves away from the crane.

14 Claims, 2 Drawing Figures

CRANE MOTION COMPENSATOR

BACKGROUND OF THE INVENTION

1. Field of the Invention

The present invention relates generally to a method and apparatus to compensate for relative vertical displacement between a loading deck and a lifting mechanism such as a crane. More particularly, the invention maintains a lift hook a fixed distance from a deck during loading and unloading operations, even though the deck is moving vertically relative to the lift hook crane assembly.

2. The Prior Art

In the environment of a lift crane mounted on a stationary offshore deck, there has previously existed a problem in loading cargo onto or off of a heaving deck for displacement by a hook and cable associated with the crane. That is, the hook and cable have been maintained substantially in a fixed position, subject only to reel in or pay out by the crane winch. As a result, the heaving deck moves relative to the crane hook, presenting a hazardous and inconvenient condition for loading or unloading. As the deck heaves, the loading crew moves vertically relative to the hook and from their perspective the fixed hook dangles in front of them. Obviously, this presents an inconvenience in attempting to either load or remove cargo from the hook. More important than the convenience factor is that of safety. That is, the loading crew is vulnerable to being struck by the hook and to the possibility of cargo being mishandled to cause injury, which possibility is enhanced by the relative vertical movement between the loading crew and the crane hook.

Other prior art attempts have been made at solving these problems. Such examples are shown in U.S. Pat. Nos. 3,309,065 to Prud'homme and No. 3,662,991 to Lakiza. However, such prior art attempts have not been totally successful in eliminating the problems associated with such a motion compensation method. Neither of these patents has solved the total combination of existing shortcomings, for example in overall product reliability, commercial feasibility, and more importantly, essentially instantaneous response time to the deck heaving action.

Accordingly, these and other shortcomings have previously existed in the prior art.

SUMMARY OF THE INVENTION

The present invention overcomes the shortcomings in the prior art in a motion compensator which includes a vertically moveable sheave over which a lift cable is reeved between a lift wench and a crane boom which positions the cable and cable hook in vertical alignment with the payload. The moveable sheave is displaced by a piston rod interconnected with a piston that is housed within a vertical pressure cylinder. The piston is displaced by a power package in response to vertical movement of a loading deck beneath the cable hook. Included in the power package in the preferred embodiment is an internal combustion engine supplying power to a variable displacement hydraulic pump that is hydraulically interconnected with the pressure cylinder. The lift cable and the lift hook are appropriately displaced by control means which sense the vertical displacement of the loading deck and provide a signal to the hydraulic pump, the output from which is regulated in order to displace the piston and sheave in direct proportion to and in the direction of the movement of the loading deck.

Additionally, the preferred embodiment includes a pneumatic pressure source for applying a substantially constant pneumatic pressure to the bottom side of the piston in order to provide an upward boost for movement of the moveable sheave under an applied load from the lift cable hook. The pneumatic pressure source may include, for example, a variable volume chamber pneumatically interconnected with one side of the pressure cylinder so that the pressure in the pneumatic source and in the pneumatic side of the pressure cylinder are maintained substantially constant, even though the piston within the pressure cylinder is displaced to move the sheave.

An air compressor may be selectively actuated to achieve and then maintain a desired pressure within the pneumatic source and pressure cylinder. Such a compressor may, for example, be driven by the internal combustion engine which supplies power to the variable displacement pump in the arrangement which includes a power distributor operatively interconnected with the internal combustion engine, the compressor and the variable displacement pump.

In the specifically disclosed embodiment, the piston in the pressure cylinder and a lower portion of the sheave piston rod adjacent the piston are hollow to form a secondary pressure chamber. The piston itself is employed to define upper and lower pressure chambers which respectively receive hydraulic and pneumatic fluid to indirectly effect displacement of the moveable sheave. A secondary rod may be interconnected with the pressure cylinder to extend vertically through the lower pneumatic chamber and into the secondary chamber, with this secondary rod including a piston on its upper end to close off the secondary chamber. In this arrangement, a pneumatic pressure means applies a substantially constant pressure to the lower primary chamber and the variable displacement hydraulic pump is hydraulically interconnected with both the upper primary chamber and the secondary pressure chamber internally of the primary piston rod. With such an arrangement, the constant pneumatic pressure supplies at least a portion of the force to displace the piston upwardly under a loaded condition when the sheave is upwardly displaced to reel in the cable so that the cable hook remains at a substantially fixed position relative to an upwardly moving deck surface. Similarly, the variable displacement pump may supply hydraulic fluid to the secondary chamber to assist in the upward displacement of the piston and sheave when the load on the cable hook exceeds the force supplied to the lower piston face by the pneumatic pressure. Alternatively, the variable hydraulic displacement pump will be used to supply hydraulic fluid under pressure to the upper primary chamber for forcing the piston downwardly against the constant pneumatic pressure when the sheave must be displaced downwardly to pay out cable for maintaining the cable hook a relatively constant distance from a downwardly moving deck surface.

It will be appreciated, that in circumstances where the weight of the load applied to the hook is sufficiently greater or smaller than the pneumatic counterbalancing force, the application of hydraulic pressure to the corresponding surface of the piston will be unnecessary to achieve the appropriate sheave movement downward or upward correspondingly. In this situation, it may be desirable to utilize the hydraulic fluid being expelled from the corresponding chamber to drive the variable displacement hydraulic pump. In this situation, the pump may be viewed as a motor that drives the engine, resulting in engine overspeed above the normally governed speed. Such a condition may be sensed to actuate an exhaust braking mechanism, in the exhaust manifold of the internal combustion engine developing engine braking proportional to engine overspeed. With this arrangement, the engine may be slowed down and the energy developed by the displacing sheave and piston rod is absorbed by the engine with no requirement of other standard components for dissapating power.

In the method of operation, the vertical displacement of the loading deck surface relative to the crane is monitored and a control signal is generated in response to relative displacement. Hydraulic output from the variable displacement hydraulic pump is varied in response to the control signal such that the direction and volume of the hydraulic output is directly proportional to the direction and extent of deck displacement. The hydraulic output from the variable displacement hydraulic pump vertically displaces a hydraulic ram by a dimension which is directly proportional to and in the direction of the deck displacement. This hydraulic ram is interconnected, as previously disclosed, to a vertically moveable sheave over which is reeved a cable carrying the loading hook. During hook displacement operation, a substantially constant pneumatic pressure is applied to a lower surface of the hydraulic ram even though the ram is displaced vertically. That is, the pneumatic pressure remains constant irrespective of ram position so as to simplify the hydraulic power requirements. This pneumatic pressure is preferably about half of the force necessary to displace the maximum static load that may be carried by the crane lift hook. Thus, the remaining portion of the unbalanced load and the power required to accelerate that load is supplied by the hydraulic system. As a result, the hydraulic system is employed accordingly. When the ram and compensating sheave are required to upwardly displace a load that exceeds the force of the pneumatic pressure, the hydraulic system provides a complementary power source to effect the displacement. When the ram and compensating sheave are required to upwardly displace a load that is less than the force applied by the pneumatic pressure, the hydraulic system provides a boost to minimize response times. When the ram and compensating sheave are displaced downwardly under a load less than the force of the pneumatic pressure, the hydraulic system is used in conjunction with the load on the compensating sheave to overcome the pneumatic pressure. When the ram and compensating sheave are to be downwardly displaced under a load that exceeds the pneumatic pressure, the hydraulic system provides a boost to overcome the pneumatic pressure and to minimize response times.

Accordingly, the present invention provides several advantages missing from the prior art.

First, variable displacement pumps in the system enable quick responses to deck displacement to achieve a smooth, continuous, and stepless displacement compensation to nullify the relative movement between the lift hook and deck.

The specific arrangement and combination of elements enables the use of a prime mover of approximately half the power than would otherwise be required without the use of the pneumatic assist in the hydraulic ram arrangement.

The overall operation itself provides several inherent advantages. For example, the cable tension may be maintained after a load is placed on the cable hook, thereby minimizing structural and cable fatigue problems. The critical adjustments and control functions of the crane operation are automatically performed, yet the crane operator is left in command of the lift system. More importantly, accidents may be prevented by maintaining a constant hook position with respect to the deck so that personnel are not placed in danger of striking the hook or mishandling the cargo during loading or unloading.

These and other advantages and meritorious features will be more fully appreciated from the following detailed description and appended claims.

DETAILED DESCRIPTION OF THE PREFERRED EMBODIMENT

The present invention is disclosed primarily in connection with a stationary cable dispensing and retrieval system, particularly a boom and winch, for loading and unloading cargo from a vertically moving deck. However, the invention is not so limited in terms of its use. For example, the invention may be used anywhere that two supports are moving vertically relative to one another and where a cable dispensing and retrieval system is mounted on one of the supports. As specific examples, the invention may be employed on sea vessel mounted cranes, deck mounted cranes where the sea may be rough, and rig mounted cranes.

Figure 1:
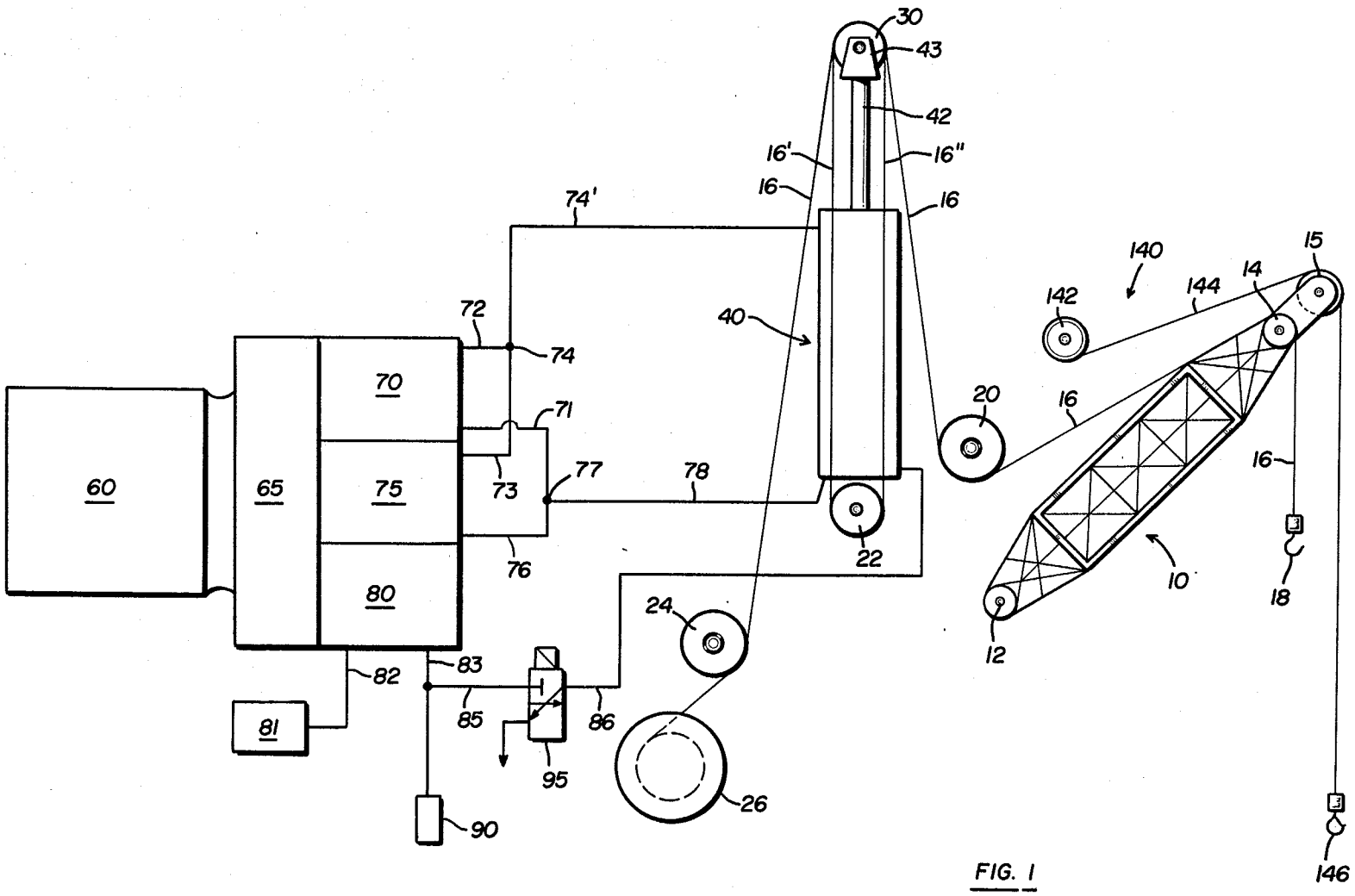
FIG. 1 schematically illustrates the crane boom and lift cable in combination with the motion compensating system and power source of the present invention.

Referring now more particularly to the drawings, FIG. 1 illustrates an exemplary setting for employing the invention. This setting includes a boom crane 10 which is pivotally mounted about an axis 12 in a conventional manner to enable the boom crane operator to position the cable and lift hook in vertical alignment with a desired position. Near the top extremity of the boom is a rotationally mounted sheave 14 over which is reeved a cable 16 carrying a lift hook 18 of conventional construction. From the sheave 14, the cable passes around a portion of a stationary and rotationally mounted sheave 20, and from sheave 20 extends generally vertically to a moveable and rotationally mounted sheave 30 which forms a part of the present invention. Cable 16 is reeved around approximately half of the sheave 30 and extends vertically downwardly to a stationary and rotationally mounted sheave 22, this portion of the cable being indicated for clarifying purposes as 16'. From sheave 22, the cable extends upwardly again and passes over moveable sheave 30, with this portion of the cable being designated as 16'', likewise for clarifying purposes. After passing once again around sheave 30, the cable extends downwardly to engage a stationary and rotationally mounted sheave 24 in proximity to a winch 26 that is driven in a conventional manner by suitable power means (not shown) to pay out or reel in the cable as desired.

Figure 2:
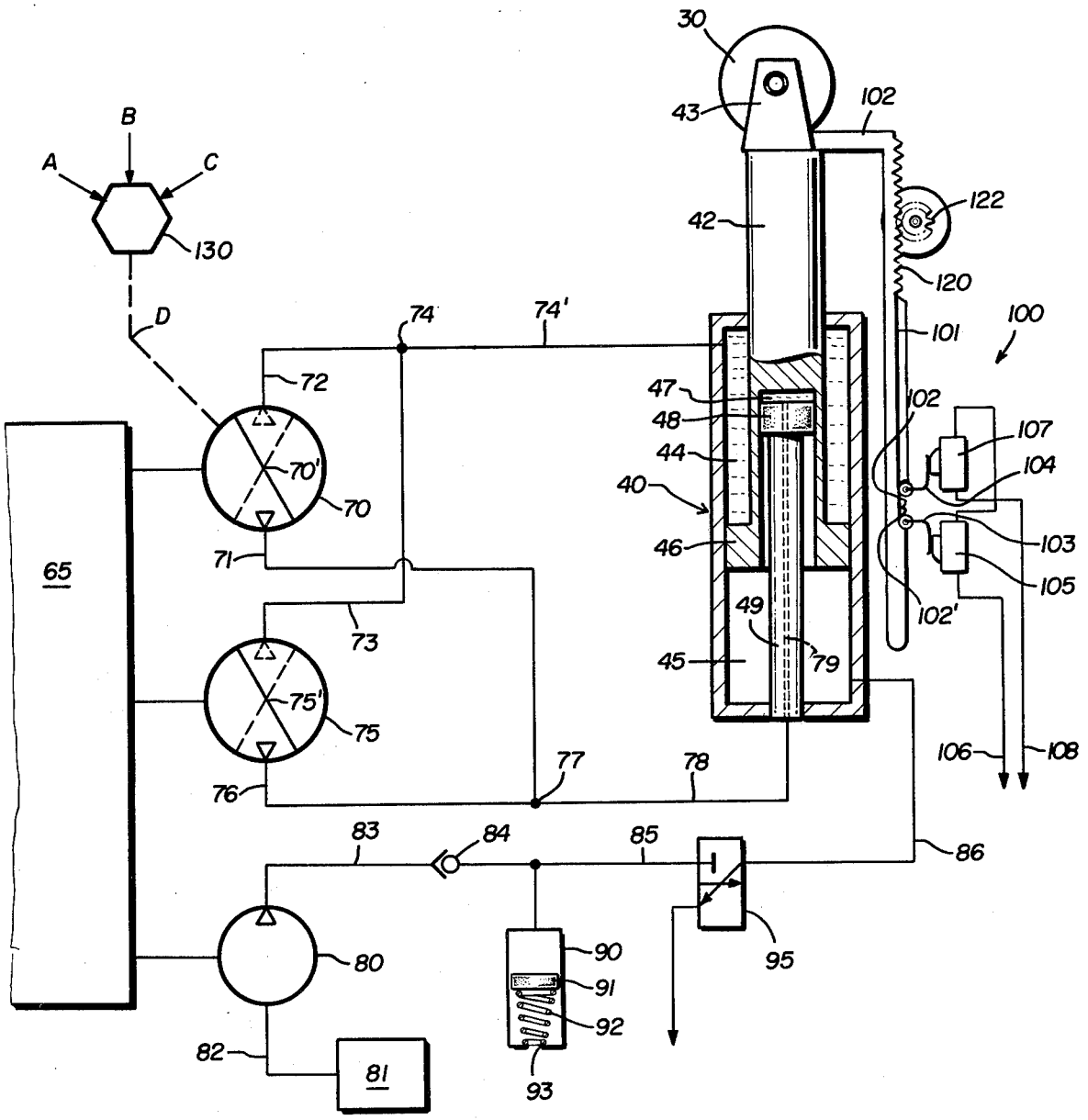
FIG. 2 schematically illustrates in greater detail the motion compensating system and a portion of the power system and control logic.

The present invention revolves around a mechanism for vertically displacing the moveable sheave 30, the power system for effecting that displacement, and the control means which regulates the power system to selectively and accurately displace the sheave 30. Referring collectively to FIGS. 1 and 2, the component most directly responsible for displacing sheave 30 includes a pressure cylinder arrangement 40 including a vertically displaceable piston rod 42 on which sheave 30 is rotationally mounted by way of a conventional U-shaped mounting bracket 43. As best shown in FIG. 2, the pressure cylinder 40 in this preferred embodiment is a combination hydraulic and pneumatically operated ram. That is, hydraulic fluid is supplied under pressure to an upper cylinder chamber designated by reference numeral 44, whereas air is supplied at a constant pressure to a lower cylinder chamber designated by reference numeral 45. These two different chambers are defined by a piston 46 on the lower terminal end of piston rod 42.

For purposes which will be more fully explained later, a secondary hydraulic chamber is formed by a hollow cavity 47 in the piston rod 42 and in the piston 46. This chamber is closed off by a stationary piston 48 which is suitably secured to a rod 49 that is likewise suitably secured to the pressure cylinder 40.

In the operation of the pressure cylinder, a constant pneumatic pressure is supplied to lower chamber 45 during operation of the motion compensator to provide a constant upward force on the piston rod 42 and the moveable sheave 30. Hydraulic fluid is alternatively supplied to and vented from both the secondary chamber 47 and the upper cylinder chamber 44 as the piston rod 42 is moved upwardly or downwardly to respectively reel in or pay out cable 16 to raise or lower the loading hook 18, in order to maintain the distance between a moving loading deck and the hook 18 substantially unchanged. It will be appreciated that the displacement of sheave 30 is directly proportional to the displacement of hook 18 and the relative displacement between a loading deck and the crane. In the present embodiment, the displacement of hook 18 is four times the displacement of sheave 30 as a result of the reeving arrangement with sheaves 20, 22, 24 and 30. Of course, cable 16 might be reeved a greater number of times around sheaves 22 and 30 so that the displacement of sheave 30 might be proportionately reduced for the same desired cable hook displacement. Similarly, the cable reeving may be reduced.

The purpose of the constantly applied pneumatic pressure is primarily to minimize the hydraulic power requirements for raising the piston rod 42 when a load is applied to the lifting hook 18. By appropriately sizing the piston 46 and selecting a desired pneumatic pressure, the force developed by the pneumatic pressure may be chosen to supply approximately half of the force for the maximum static load on the system. For example, the pneumatic pressure may be set at essentially a constant of 1400 psi to develop a constant upward force on the piston of about five tons in a system having a maximum ten ton static load rating. Thus, the forces that must be developed in secondary chamber 47 to vertically displace such a load is only five tons, enabling simplification in the overall hydraulic system and reducing hydraulic losses from leakage which would result from otherwise higher pressure requirements. Also, the pneumatic boost enables quicker response times to more accurately and more quickly displace the lift hook 18 as relative vertical displacement between the loading deck and the boom crane occurs.

Of course, the upwardly applied constant force from the pneumatic chamber 45 must be hydraulically overcome to lower piston rod 42 and sheave 30 to lower cable hook 18. However, the load on the cable will supply at least a portion of this force requirement, with the hydraulic pressure applied to chamber 44 providing the remainder of this force requirement. Overall, this arrangement is highly desireable from a feasibility and response standpoint.

It will be appreciated, that in circumstances where the weight of the load applied to the hook is sufficiently greater or smaller than the pneumatic counterbalancing force the application of hydraulic pressure to the corresponding surface of the piston will be unnecessary to achieve the appropriate sheave movement downward or upward correspondingly. In either of these situations, it may be desirable to utilize the hydraulic fluid being expelled from the corresponding chamber to drive the variable displacement hydraulic pump. In this situation, the pump may be viewed as a motor that drives the engine, resulting in engine overspeed above the normally governed speed. Such a condition may be sensed to actuate an exhaust braking mechanism, in the exhaust manifold of the internal combustion engine, developing engine braking proportional to engine overspeed. With this arrangement, the engine may be slowed down and the energy developed by the displacing sheave and piston rod is absorbed by the engine with no requirement of other standard components for dissapating power.

More specifically, when the load is light in comparison to the pneumatic force and the piston rod 42 is being moved upwardly, hydraulic fluid is being extracted from the chamber 44 to, in effect, drive the input shaft of displacement pumps 70 and 75. These shafts then act as an input to the internal combustion engine and may cause an overspeed. A similar condition will exist when the load is heavy in comparison to the pneumatic force and the piston rod is moving downwardly.

Such conditions may be detected by a suitable control, which then closes a braking mechanism in the engine exhaust manifold. For example, such a braking mechanism might include a servo-controlled butterfly or guillotine type valve which would selectively and steplessly restrict the flow of exhaust gases and thereby perform a braking function for the engine and the displacement pumps proportional to the engine overspeed. Exhaust braking has been employed in other environments, such as in automotive exhaust manifolds to brake the vehicle speed, for example, on the downslope of hills, but these prior uses are restricted to an on or off mode. However, use of this feature as disclosed is novel, especially in the environment of motion compensation, and particularly where the exhaust braking is controlled to vary exhaust restriction, proportional to the braking requirement dictated by the overspeed. The technology from those prior uses is incorporated herein.

Referring back to FIG. 1, the overall power system for effecting the displacement of piston rod 42 and sheave 30 includes a prime mover or primary power source 60, a power distributor 65, a pair of variable displacement hydraulic pumps 70 and 75, and an air compressor 80.

The prime mover 60 is preferably an internal combustion engine, with such a suitable engine being a diesel engine manufactured and distributed by Magirus Humboltz Dentz AG under the product designation BF10L413. Of course, other suitable prime movers may be employed, even prime movers other than an internal combustion engine such as a regenerative type electric motor.

The power distributor 65 is, likewise, an item which may be purchased commercially. For example, such a power distributor, or splitter box, may be purchased from Funk Corp. under the model designation 593P. In essence, the power distributor 65 receives power input from the prime mover 60 and splits or distributes that power input as output to three different sources, namely the two variable displacement hydraulic pumps 70 and 75 and the compressor 80.

The variable displacement hydraulic pumps 70 and 75 are chosen primarily because of their quick response and ability to provide only the amount of hydraulic fluid demanded by the system at any particular time and to provide that hydraulic fluid at an adjustable pressure to maintain the necessary displacement forces on the power ram mechanism 40. Suitable pumps may be purchased from Eaton Fluid Power Products under the model designation PV76. Of course, other equivalent type hydraulic sources may be used and a single variable displacement pump may be employed instead of the two pumps, as shown, if the power requirements are such that will permit. The previously mentioned displacement pumps of Eaton may be selected with an appropriate override mechanism which will prevent system overload.

As shown in FIG. 2, the variable displacement hydraulic pumps 70 and 75 are of the swashplate type, with the respective swashplates being indicated by reference numerals 70' and 75'. As is well known in the art, the position of the swashplate governs the hydraulic output and the direction of the output. For example, with the swashplates 70' and 75' as positioned in FIG. 2, the hydraulic output from the pumps will be respectively through lines 71 and 76 which intersect at a junction 77, with hydraulic fluid flowing from that junction through hydraulic leg 78, then through an opening 79 in rod 49 into secondary chamber 47. Therefore, with the unit in operation as illustrated, hydraulic fluid is being supplied to assist the pneumatic pressure in chamber 45 to lift piston rod 42 and sheave 30 to reel in the lift hook 18.

With the swashplates positioned as shown in the dashed or phantom lines in FIG. 2, the hydraulic output would be from the pumps 70 and 75 respectively to hydraulic lines 72 and 73, meeting at intersection 74. From this point, the hydraulic fluid would flow through hydraulic line 74' and into the upper hydraulic chamber of ram assembly 40 to apply a downward force on the upper surface of piston 46 to displace piston rod 42 and sheave 30 downwardly to pay out the cable 16 and thereby lower lift hook 18.

As shown, the hydraulic flow lines establish a closed loop system, which includes the pumps and the pressure cylinder chambers.

The compressor 80 receives power input from the power distributor 65 and is selectively actuatable to supply air under pressure for supply to the pneumatic chamber 45 of the pressure cylinder 40. A suitable air compressor may be obtained from Ingersoll-Rand Company under the model designation 223Bare.

In the operation of the compressor, air is received from an optional, conventional air dryer 81 by way of flow line 82. Output from the compressor 80 is through an air flow line 83, through a one way check valve 84, shown in FIG. 2, to an air accumulator 90. This accumulator may take several configurations, but basically is of the type including a variable volume chamber to supply air under a substantially constant pressure to the pneumatic chamber 45. As shown in FIG. 2, the accumulator may include a floating piston 91 biased against a conically configured spring 92, which provides the constant pneumatic pressure. Other spring arrangements may include a variable wire diameter spring to achieve the same result. As illustrated, accumulator 90 will preferably include an opening 93 at its non-pressurized end, to accommodate escape of air as piston 91 is displaced against the biasing force of the spring 92 in response to the supply of air by compressor 80.

As will be appreciated, it is not necessary to continuously operate the compressor. Basically, the compressor is actuated to initially achieve the desired pressure within the accumulator and then later to periodically supply enough air to make up for any leakage losses so as to maintain the pressure at the desired level. A suitable sensing mechanism (not shown) may be employed to monitor the pressure in accumulator 90 and to then selectively actuate the compressor.

When it is desired to supply air from accumulator 90 to chamber 45, a three-way, solenoid-operated valve 95 is displaced from its "closed" position as shown to a position accommodating air flow from the accumulator 90 through pneumatic line sections 85 and 86. The configuration of three-way valve 95 is selected to permit air to vent from chamber 45 to atmosphere when placed in the "closed" position so that the piston rod 42 may retract into cylinder 40 to avoid exposure to corrosive elements such as seawater when the motion compensator is deactivated.

As shown in FIG. 2, the system also optionally includes a centering assembly 100 mounted on piston rod 42 for positioning piston 46 in essentially the mid axial point of cylinder 40 prior to any compensating displacement. In this manner, piston 46 has the capacity of being displaced half the axial internal length of cylinder 40 in either direction. This arrangement includes an elongated rod 101 secured to piston rod 42 by a flange 102. The rod includes teeth 120, which form a portion of the control mechanism as disclosed later. Additionally, the rod 101 includes a recessed cam surface 102 that is used to position the piston 46 at the desired midpoint. Another similar rod is connected to the piston 42 and includes a recess 102' which overlaps only the central portion of recess 102, this other rod being behind rod 101 as viewed from FIG. 1. A pair of micro-switches 103 and 104 are shown in an "off" position in the respective recesses 102 and 102', indicating that the piston 46 is essentially in the desired position. These micro-switches 102 and 103 are a part of respective relay signal generators 105 and 107 which may respectively transmit electrical impulses along lines 106 and 108 to a control system, shown schematically in FIG. 2 by reference numeral 130. The signals transmitted along lines 106 and 108 are schematically represented as signals "A" as input to the controller 130.

The centering assembly 100 is primarily for positioning the piston 46 at the very beginning of motion compensation operation. After an initial centering operation, the assembly 100 may be manually or automatically placed in a non-operative mode. While in centering operation, the micro-switches 103 and 104 indicate whether or not the piston 46 is positioned as desired. That is, if the micro-switches are in an on position, hydraulic fluid will be supplied to either chambers 44 or 47 to displace the piston toward the midpoint position. Once that position has been reached, micro-switches 103 and 104 drop into the respective recesses 102 or 102', placing them in an off position and indicating that the motion compensation arrangement is ready for compensation.

A part of the control mechanism for accurately and properly positioning sheave 30 includes a rotatable sprocket 122 which includes teeth meshing with the teeth 120 on rod 101. As sheave 30 is displaced either upwardly or downwardly, the teeth 102 act as a rack generating rotational motion of the sprocket or pinion 122, which may be electrically interconnected with a conventional position sensing or velocity sensing mechanism (not shown) such as a tachometer generator. Such a sensing mechanism will generate an electrical impulse that may be fed to a comparator within the control system 130, such an impulse being schematically illustrated as impulse "B". This impulse will then be compared with an impulse generated by a separate sensing mechanism connected with the moving deck to then generate an appropriate command signal "D" to properly position the swashplates in the variable displacement hydraulic pumps 70 and 75.

The subsystem for sensing the position of the moving deck is shown in FIG. 1 generally by reference numeral 140. This system includes a reel 142, to which is connected a cable 144 having a hook 146 at its end for connection to the moveable deck. The cable 144 is reeved over a sheave 15 rotationally mounted on crane boom 10, thereby positioning the hook 146 in close vertical proximity to lift hook 18 so that the deck movement that is sensed by system 140 is then translated into accurate displacement of hook 18.

Hook 146 may optionally include a sensing element (not shown) to detect when the hook has been attached to the deck support surface. Such a sensing element would then transmit a signal back to the control system 130 to simply indicate that the motion compensation device is ready for operation. If such a feature is used, an override could be employed in the control 130 to maintain the motion compensator inoperative until the hook 146 is attached to the deck and closed.

Reel 142 may also be interconnected with a conventional position sensing or velocity sensing device, such as a tachometer generator, which will generate an electrical impulse signal to the control 130 in response to movement of hook 146. This impulse is schematically illustrated in FIG. 2 as "C"; and as previously discussed, this signal may be fed to a comparator where it is compared to signal "B" for mechanism 122 to generate the appropriate command signal "D".

As a very desireable feature, reel 142 is preferably spring loaded or biased in some equivalent manner so that cable 144 is maintained taut after cable 146 is attached to the moving deck.

It will be appreciated that various modifications may be made to the disclosed preferred embodiment without departing from the overall invention. For example, the pneumatic pressure applied to chamber 45 may be chosen so high in proportion to the loads to be lifted that chamber 47 could be eliminated. However, to maintain desired response times, such as modification is not preferred.

Having therefore completely and sufficiently disclosed my invention, I now claim:

1. A motion compensator for use with a crane which lifts loads from a vertically and erratically moving deck such as an offshore heaving deck comprising:

a displaceable compensating sheave to receive a lift cable of the crane and for displacing the cable in proportion to displacement of the moving deck;

a piston, piston rod and cylinder arrangement for effecting the displacement of the compensating sheave, the piston being movable within the cylinder, the piston rod being interconnected between the piston and the displaceable sheave, and the piston and piston rod having first and second surfaces on one side thereof for respectively receiving the application of pneumatic and hydraulic pressure;

pressure means for applying a pneumatic force to said first surface of said piston and piston rod arrangement to provide at least a portion of the force for displacing the piston in the direction of the sheave;

a variable displacement hydraulic pump selectively varying the hydraulic flow volume and rate to the other side of the piston and to the second surface of said piston and piston rod arrangement; and control means sensing the vertical movement of a deck and responding to the position of a moving deck by regulating the flow volume and rate output of said variable displacement hydraulic pump such that the piston rod is displaced in response to the output of said power means to achieve displacement of the compensating sheave by an amount which is directly proportional to the displacement of the moving deck.

2. A motion compensator as defined in claim 1, characterized by the pressure means applying a substantially constant pneumatic force equivalent to essentially half of the maximum rated load capacity on the cable for counterbalancing the displacement of the piston.

3. A motion compensator as defined in claim 1, including a prime mover supplying energy to said variable displacement pump.

4. A motion compensator as defined in claim 2, characterized by said pressure means including a variable volume accumulator chamber in pneumatic communication with said first piston surface, and further including a selectively actuatable compressor for supplying air under pressure to the accumulator chamber.

5. A motion compensator as defined in claim 4, further including an internal combustion engine supplying energy to the compressor and to said power means through a power output distributor.

6. A motion compensator for vertically displacing a lift hook and lift cable of a crane in substantially equivalent distances as the relative displacement between the crane and a loading deck, comprising:

a movable sheave over which the lift cable is reeved;

a displaceable piston rod interconnected between the movable sheave and a piston which is housed within a pressure cylinder;

a power package for displacing the piston in response to the relative vertical movement between the crane and the loading deck, including (a) a swash-plate type variable displacement hydraulic pump which is hydraulically interconnected with the pressure cylinder for supplying hydraulic fluid in variable volumes and flow rates to opposite sides of the cylinder to effect movement of the piston in both directions, the swash-plate of the pump being regulated to control the amount of hydraulic fluid demanded by the system to provide the needed displacement forces to the displaceable piston rod, and (b) a prime mover supplying power to the variable displacement pump;

a pneumatic pressure source for applying a substantially constant pneumatic pressure to a portion of one side of the piston to assist the movement of the movable sheave in the direction of pneumatic pressure application under a load applied to the lift cable, an air compressor for supplying air under pressure to the pressure source and a power distributor operatively interconnecting the prime mover with both the compressor and the variable displacement pump; and control means sensing vertical displacement between the crane and the loading deck and providing a signal to the hydraulic pump to regulate the output from the pump in order to displace the piston and sheave in direct proportion to the relative movement.

7. A motion compensator as defined in claim 6, characterized by the power package including a pair of variable displacement hydraulic pumps which are both operatively interconnected with the power distributor and are both hydraulically interconnected with the pressure cylinder.

8. In a method of reducing the power required to vertically displace a load on a lifting cable by the same distance of displacement as a vertically moving loading deck, such as an offshore deck heaving in response to wave action, the steps of:

constantly applying pneumatic pressure to a first surface on one side of a displacement member that is interconnected with a compensating sheave over which a lifting cable is reeved;

in response to vertical displacement of the loading deck, varying the output volume and direction and flow rate of a swash-plate type variable displacement hydraulic power source and thereby performing the steps of:

(a) when the deck moves downwardly, applying hydraulic pressure by hydraulic fluid supplied by said swash-plate type variable displacement hydraulic power source to a surface on a second side of the displacement member and counterbalancing the force applied by the pneumatic pressure to displace the compensating sheave a distance in a first direction proportionate to the downward movement of the deck; and (b) when the deck moves upwardly, extracting hydraulic fluid from the surface on the second side of the displacement member by said variable displacement hydraulic power source and displacing the compensating sheave in a second direction at least in part by the pneumatic pressure and by applying hydraulic pressure to a second surface on the one side of the displacement member to assist the pneumatic pressure application in achieving a rapid sheave displacement, the hydraulic pressure being applied by a volume of hydraulic fluid supplied by said variable displacement hydraulic power source.

9. A motion compensator for use with a crane which lifts loads from a vertically and erratically moving deck such as an offshore heaving deck, comprising:

a vertically displaceable compensating sheave to receive a lift cable of the crane and for displacing the cable in the direction of and in proportion to displacement of the moving deck;

a piston, piston rod and cylinder arrangement for effecting the vertical displacement of the compensating sheave, the cylinder being vertically oriented when positioned for operation, the piston being vertically moveable within the cylinder, and the piston rod being interconnected between the piston and the displaceable sheave, characterized by said piston and an end portion of said piston rod adjacent to said piston being hollowed to form a secondary chamber, and further including a secondary rod secured to the cylinder extending through that portion of the cylinder associated with the pneumatic side of the piston and terminating in a secondary piston received within the secondary chamber;

pressure means for applying a substantially constant pneumatic force to the lower surface of said piston to provide at least a portion of the force for upwardly displacing the piston;

power means for selectively applying a variable force to the top side of the piston and alternatively to the secondary chamber of the piston and piston arrangement; and control means responsive to the position of a moving deck for regulating the output of said power means such that the piston rod is vertically displaced in response to the output of said power means to achieve displacement of the compensating sheave by an amount which is directly proportional to the displacement of the moving deck.

10. A motion compensator as defined in claim 9, wherein the power means includes a variable displacement hydraulic pump hydraulically interconnected with the secondary chamber and the upper portion of said cylinder.

11. A motion compensator as defined in claim 10, characterized by said power means including a pair of variable displacement hydraulic pumps, further including a compressor for supplying air under pressure to the pressure means, and an internal combustion engine supplying energy to the hydraulic pumps and to the compressor through a power output distributor.

12. A motion compensator for vertically displacing a lift hook and lift cable of a crane in substantially equivalent distances as the relative displacement between the crane and a loading deck, comprising:

a vertically moveable sheave over which the lift cable is reeved;

a vertically displaceable piston rod interconnected between the moveable sheave and a piston which is housed within a vertical pressure cylinder, characterized by the piston and a lower portion of the piston rod adjacent the piston being hollow to form a secondary chamber, the piston forming lower and upper primary chambers within the pressure cylinder, and further including a secondary rod interconnected with the pressure cylinder and extending vertically through the lower primary chamber and into the secondary chamber, a secondary piston member on the upper end of the secondary rod and defining a closure for the secondary chamber;

a pneumatic pressure means for applying a substantially constant pressure to the lower primary chamber;

a power package for displacing the piston in response to the relative vertical movement between the crane and the loading deck, including (a) a variable displacement hydraulic pump which is hydraulically interconnected with the pressure cylinder and (b) a prime mover supplying power to the variable displacement pump, with the variable displacement hydraulic pump being hydraulically interconnected with both the upper primary chamber and the secondary chamber, such that the constant pneumatic pressure supplies at least a portion of the force to displace the piston upwardly under a loaded condition, such that the variable displacement pump may supply hydraulic fluid to the secondary chamber to assist in the upward displacement of the piston particularly when the load on the moveable sheave exceeds the force supplied to the lower piston face by the pneumatic pressure, and such that the variable hydraulic pump may supply hydraulic fluid to the upper primary chamber to displace the piston downwardly against the constant force on the piston from the pneumatic pressure in the lower chamber; and control means sensing vertical displacement between the crane and the loading deck and providing a signal to the hydraulic pump to regulate the output from the pump in order to displace the piston and sheave in direct proportion to and in the direction of the relative movement.

13. In a method of vertically displacing a lift hook and lift cable essentially the same distance as the vertical displacement of a heaving loading deck, the steps of:

sensing the vertical displacement of the loading deck and generating a proportional control signal in response thereto;

varying the hydraulic flow from a variable displacement hydraulic pump in response to the control signal such that the direction and volume and flow rate of the output from the hydraulic pump is directly proportional to the direction and extent of displacement of the loading deck;

supplying the output from the variable displacement hydraulic pump alternatively to one of two sides of a piston in a hydraulic ram arrangement and simultaneously withdrawing hydraulic fluid from the other side of the piston;

displacing the hydraulic ram with the output from the hydraulic pump by a dimension which is directly proportional to the deck displacement, the ram being interconnected to a moveable sheave over which is reeved a cable that has a hook connected to its end for carrying a load that is to be lifted from or placed on the loading deck, such that the sheave is moved by a dimension proportional to the deck displacement in response to movement of the hydraulic ram;

supplying power to the variable displacement hydraulic pump by an internal combustion engine; and selectively braking an overspeed condition in the engine which is developed as a result of the hydraulic ram being displaced to pump hydraulic fluid through the variable displacement pump, by variably and steplessly restricting the outward flow of exhaust gases from the exhaust manifold of the engine and thereby creating a selected, variable resistance to engine operation and indirectly to the hydraulic fluid being pumped through the displacement pump.

14. In a method of vertically displacing a lift hook and lift cable essentially the same distance as the vertical displacement of a heaving loading deck, the steps of:

sensing the vertical displacement of the loading deck and generating a proportional control signal in response thereto;

varying the hydraulic flow from a variable displacement hydraulic pump in response to the control signal such that the direction and volume and flow rate of the output from the hydraulic pump is directly proportional to the direction and extent of displacement of the loading deck;

supplying the output from the variable displacement hydraulic pump alternatively to one of two sides of a piston in a hydraulic ram arrangement and simultaneously withdrawing hydraulic fluid from the other side of the portion; and displacing the hydraulic ram with the output from the hydraulic pump by a dimension which is directly proportional to the deck displacement, the ram being interconnected to a movable sheave over which is reeved a cable that has a hook connected to its end for carrying a load that is to be lifted from or placed on the loading deck, such that the sheave is moved by a dimension proportional to the deck displacement in response to movement of the hydraulic ram; and during the hook displacement operation, constantly applying a pneumatic pressure to a portion of one side of the hydraulic ram as the ram is displaced, in order to provide at least about half of the force when the ram is displaced against the load.

* * * * *